US008266938B2

(12) United States Patent
Bradley et al.

(10) Patent No.: US 8,266,938 B2
(45) Date of Patent: Sep. 18, 2012

(54) EMBOSSED SHAPE MEMORY SHEET METAL ARTICLE

(75) Inventors: John R. Bradley, Clarkston, MI (US); Paul E. Krajewski, Troy, MI (US); Yang T. Cheng, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 578 days.

(21) Appl. No.: 12/546,767

(22) Filed: Aug. 25, 2009

(65) Prior Publication Data

US 2011/0048096 A1 Mar. 3, 2011

(51) Int. Cl.
*B21D 26/14* (2006.01)
*B21J 5/04* (2006.01)

(52) U.S. Cl. ..... 72/56; 72/707; 29/419.2

(58) Field of Classification Search ..... 72/54, 56, 72/57, 707; 29/419.2, 421.1
See application file for complete search history.

(56) References Cited

U.S. PATENT DOCUMENTS

| | | | | |
|---|---|---|---|---|
| 7,069,756 | B2 * | 7/2006 | Daehn | 72/56 |
| 7,076,981 | B2 * | 7/2006 | Bradley et al. | 72/56 |
| 7,389,664 | B1 * | 6/2008 | Cheng et al. | 72/56 |
| 7,563,334 | B2 | 7/2009 | Zhang et al. | |
| 7,954,357 | B2 * | 6/2011 | Bradley et al. | 72/466.8 |
| 2009/0090162 | A1 | 4/2009 | Bradley et al. | |

OTHER PUBLICATIONS

Wangyang Ni et al; Recovery of microindents in a nickel-titanium shape-memory alloy: A "self-healing" effect; Applied Physics Letters; May 6, 2002; vol. 80, No. 18, pp. 3310-3312.
H. Hocheng et al.; Electromagnetic force-assisted imprint technology for fabrication of submicron-structure; Microelectronic Engineering; vol. 85 (2008); pp. 1652-1657.

* cited by examiner

*Primary Examiner* — David B Jones
(74) *Attorney, Agent, or Firm* — Reising Ethington P.C.

(57) ABSTRACT

Electromagnetic forming methods suitable for creating surface features on a shape memory alloy are described. Features may be created over a range of scales, including those suitable for the generation of holographic images. Features, images, or patterns may be made capable of reversibly appearing and disappearing as a result of changes in temperature and may include temperature sensitive displays for automotive and other applications.

20 Claims, 4 Drawing Sheets

EMBOSSED SHAPE MEMORY SHEET METAL ARTICLE

TECHNICAL FIELD

This invention pertains to the fabrication and use of a sheet metal or metal foil article having shape memory properties and embossed with a pattern which may be rendered more or less visible with change in temperature.

BACKGROUND OF THE INVENTION

It would be useful to have metal articles with surface features, images, or patterns capable of reversibly appearing and disappearing as a result of changes in temperature. Such articles may include temperature sensitive displays for automotive and other applications.

For example, an instrument panel display might be adapted to indicate an on/off condition of a vehicle accessory. Another application might include machinery temperature sensors and control indicators. In still another application an article might be encoded with a security code, identification number or the like which is made visible by external heating. It is an object of this invention to provide a temperature sensitive material with a surface image that may be made visible or invisible with a temperature change.

Some metallic alloys, collectively known as Shape Memory Alloys (SMA), possess the useful property that when suitably processed they may change their shape under the influence of relatively modest temperature changes. This shape change may occur at temperatures not much different than room temperature or about 25° C. It is the purpose of this invention to provide methods for fabricating embossed articles from shape memory alloy sheets or foils which, upon suitable temperature change, will modify their shape to an extent and in a manner to render the embossed surface image visible or invisible.

SUMMARY OF THE INVENTION

This invention provides a method of deforming the surface of a workpiece of shape memory alloy composition so that an information-containing image is visible when the workpiece is later heated to a predetermined temperature. The workpiece will often be in the form of a sheet or foil of a thickness suitable to undergo the deformation necessary for yielding a visible image and for the deformed region to respond as desired to temperature induced metallurgical phase changes, each requirement being consistent with the physical properties of the shape memory alloy. The deformed shape memory alloy workpiece may be used alone or it may be applied to another article (e.g., a structure or mechanism) for displaying its image when exposed to a temperature at which the image is to be viewed.

Such an image may require an appreciable surface area on a relatively thin workpiece and the complementary depressions and elevations in the metal surface need to be of sufficient depth and elevation to form a desired image. In many embodiments, the deformed surface is characterized by heights and depths of up to a millimeter or so from the general surface profile of the workpiece. It is preferred that the image be formed on the surface of the shape memory alloy composition by an electromagnetic forming process. The workpiece may have previously been deformed to impart a general shape before an image is impressed on it. A die or other forming tool is shaped with the inverse image. Depending on the desired detail of the image, the tool image may be formed by a lithographic process. The forming tool may be propelled by a momentary electromagnetic force against the surface of the workpiece or vice versa. In many embodiments, the workpiece, backed by a driver plate and an interposed elastomeric cushioning layer, is propelled against the tool surface so as to better obtain the desired image.

Electromagnetic forming takes advantage of the large forces that may be created through electromagnetic repulsion. A magnetic field is generated when a time-varying or alternating current is passed through an electrical conductor. By configuring the conductor as an electromagnetic coil, the magnetic field may be concentrated and focused to generate intense local magnetic fields. If a conductive target is now positioned in the generated magnetic field, the magnetic field of the coil will induce an eddy current in the target. In turn, the eddy current in the target will produce its own magnetic field which opposes the field produced by the coil thereby generating repulsive interaction between them. By fixedly locating the coil but not constraining or only minimally constraining the target, these repulsive forces will rapidly accelerate the target out of the zone of influence of the coil.

If the target is the workpiece, or the object to be formed, then positioning a suitably shaped stationary die in the path of the accelerated target will lead to the target impacting the die, deforming and taking on the shape of the die and thereby adopting the desired shape. Alternatively it may be desirable to accelerate the die and maintain the workpiece stationary. Again the impact of the die and the workpiece will impart the desired shape to the workpiece, which in practice of this invention is a shape memory alloy.

All of the shape memory alloys, of which the best known is a nickel titanium alloy comprising substantially equal atomic fractions of nickel and titanium, exhibit unusual behavior compared to most metallic alloys—they may be processed to adopt different shapes at different temperatures without application of external force.

The origin of this behavior lies in the ability of shape memory alloys to exist in two crystallographic forms depending on temperature and to transform from one to another as the temperature is raised or lowered. For the equi-atomic NiTi shape memory alloy the temperature at which this transition occurs is about 35° C. but this may be modified by minor, on the order of 1 or 2%, deviations from a 1:1 ratio of nickel and titanium atoms.

Conventionally the high temperature phase of all shape memory alloys is known as the austenite phase and the low temperature form is known as the martensite phase. The basis for the observed behavior of shape memory alloys is that the crystal structures of the austenite and martensite phases are simply related and the pathway by which one transforms to the other is reversible. Simply put, the transformation of austenite to martensite is, even on an atomic level, the inverse of the transformation from martensite to austenite.

Remarkably this ability to reverse the transformation path from martensite to austenite is maintained even if the martensite is deformed to a limited extent, generally to a critical strain of less than about 5-7%, depending on the specific alloy composition. Thus it is possible to: cool an austenite article of specified shape through its transition temperature to form a martensite article of the same specified shape; deform the martensite article (by less than the critical strain) to generate a martensite article of a second shape; heat the deformed martensite in the second shape to above the transition temperature to re-form austenite; and as it transforms to austenite have the article adopt its original specified shape. The entire process including the deformation step may be repeated as often as desired. However once again cooling the austenite article, in its original specified shape, below its transition temperature without deformation will not result in any shape changes in the martensite article thus formed. Because of this inability to change shape more than once for each imposed deformation, this behavior is frequently called a 'one-way shape memory effect'.

More complex behavior results if, in the above example, the martensite article is deformed to a second shape which requires greater than the critical strain. Now, heating the deformed martensite article above the transition temperature results in only partial recovery of the original specified shape by the resulting austenite article. However, on subsequent cooling below the transition temperature the resulting martensite article will once again adopt its deformed second shape and continued temperature cycling above and below the transition temperature enables repeated transitions between the two shapes characteristic of the two phases. This behavior is described as a 'two-way shape memory effect'.

The utility of the shape-recovering characteristics of shape memory alloys will be exploited in this invention, particularly the shape-recovering characteristics of these materials when in the form of thin films foils or sheets. As will be evident in the following detailed description yet further useful behavior and characteristics of shape memory alloys may be exploited through introduction of additional processing steps.

In practice of this invention the shape imparting properties of electromagnetic forming will be used to condition shape memory alloys in the form of thin films foils or sheets, so that after subsequent processing they may be rendered suitable for applications requiring surface features whose visibility may be adjusted by changes in temperature.

BRIEF DESCRIPTION OF THE DRAWINGS

FIG. 2A shows these features as illustrated in FIG. 1, that is, for a flat forming surface, while FIG. 2B shows the situation corresponding to the case of a contoured forming surface.

In FIG. 6A, no image is visible; in FIG. 6B, one element of the image is visible; in FIG. 6C a second image is visible and may be viewed in conjunction with the first image shown in FIG. 6B.

DESCRIPTION OF PREFERRED EMBODIMENTS

This invention is directed towards articles and processes for embossed and impressed SMA sheet or foil generally. However, a significant benefit conferred by this invention is the possibility of reducing the scale of the embossments or impressions.

Generally the transfer of fine features to an article is accomplished by pressing metal dies imprinted or machined with a complementary pattern into a ductile blank in a high pressure coining press. Recently however methods using electromagnetic actuation have been developed. These electromagnetic actuators rely on magnetic repulsion between an electromagnetic coil and a target when the electromagnetic coil is energized by a current pulse resulting from the discharge of a capacitor bank. The capacitor discharge generates a large current pulse which produces a rapidly changing magnetic field in the coil. In turn this induces a current in a metallic striker plate positioned proximate to the electromagnet which generates its own magnetic field. The magnetic fields of the coil and striker repel and propel the striker toward a target.

Generally in electromagnetic forming it is desirable to minimize the inertia of the striker. Hence the article to be formed, or in this case impressed, will many times be the striker and be propelled toward the stationary die.

For maximum induced current, and thus for maximum forming pressure, a low resistivity metal, preferably of less than 15 microhm-cm, should be used as the striker material. The electrical resistivity of Nickel-Titanium SMAs is about 80 microhm-cm versus less than 6 microhm-cm for copper, nickel or aluminum. Thus using SMAs directly as the striker is not optimal.

An additional issue is that for maximum forming pressure the striker should be an effective magnetic shield so that the maximum eddy current may be induced in the striker. It is well recognized that the AC current in a conductor is carried in a layer of thickness of about five times the skin depth, with approximately 36% of the current carried in a surface layer of thickness equal to the skin depth. Thus it is clear that efficient coupling between the magnetic field and the striker calls for a striker with a thickness at least comparable to the skin depth and ideally with a thickness equal to several skin depths.

Current SMA sheet and foil products are available in thicknesses ranging from about 10 micrometers to about 2000 micrometers, but the practice of this invention is primarily directed to the thickness range of from about 20 micrometers to 300 micrometers. Thus for these thin SMA sheets or foils whose thickness is appreciably less than the skin depth, even those with desirably low resistivity, it may be more effective to simply place the SMA foil on the die and use a separate striker of the desired conductivity and thickness.

Figure 1:
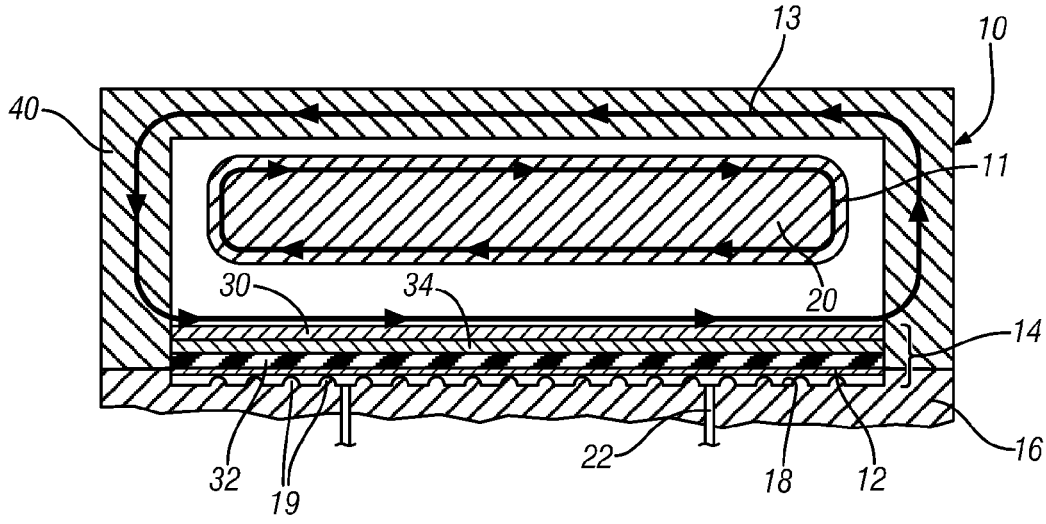
FIG. 1 is a schematic illustration of an electromagnetic forming apparatus configured to form an image on a shape memory alloy metal workpiece by electromagnetic forming, the apparatus being in the closed, operating position.

An example of a suitable re-usable striker, a multi-layer driver plate, is shown in FIG. 1 which depicts an electromagnetic forming system 10 generally suitable for the practice of the invention. The key features of the electromagnetic forming system are: an electromagnetic actuator 20; a workpiece 12; a forming tool 16, with vents 22 for release of any gases trapped between tool 16 and workpiece 12; and the multi-layer driver plate 14, all of which are shown in a configuration generally suitable for the practice of the invention. The electrical current paths in actuator 20 are shown as 11 and 13, where 11 depicts the current flow in the coil and 13 depicts the opposing current flow due to the induced eddy currents in the driver plate 14 and a portion of conductive frame 40. It is these opposing currents and the opposing magnetic fields they generate which develop the desired forming pressure.

Figure 2A:
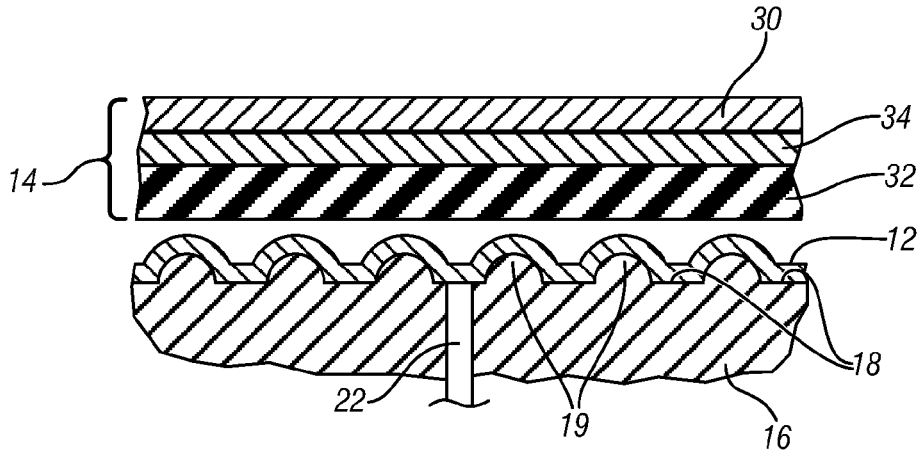
FIGS. 2A and 2B show two configurations of a multi-piece driver plate and corresponding forming surface.
Figure 2B:
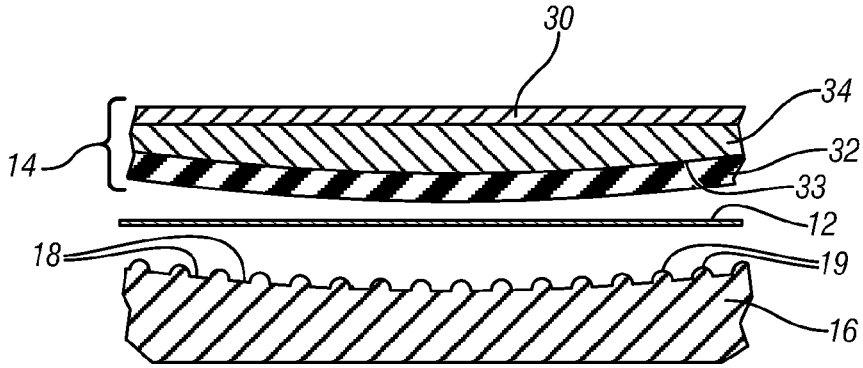

FIGS. 2A and 2B show the multi-layer driver plate in greater detail, illustrating that it comprises: a conductive layer 30 which is positioned (FIG. 1) adjacent the electromagnetic actuator 20; a second layer 32 positioned (FIG. 1) adjacent the workpiece 12; and a third layer 34, positioned between layers 30 and 32. Second layer 32 comprises a suitable thickness of deformable elastomeric material which will press the workpiece against the shaping surface 18 of forming tool 16 when so urged by the electromagnetic force applied to conductive layer 30. Second layer 32 will temporarily deform and conform to the geometry of shaping surface 18 to efficiently deform workpiece 12 when subject to the electromagnetic force, but recover its original shape when the forming operation is complete and the load is removed.

The multi-layer driver plate 14 is intended to participate in numerous forming cycles without replacement. Thus layers 30 and 34 are intended to be of sufficient strength and rigidity as to experience only modest, recoverable elastic deformation in use. Layer 32 is intended to be fabricated of a rubber or elastomer material exhibiting appropriate strength and flexibility characteristics sufficient to sustain, without compromise to its function, repeated loads and deformations. It will be appreciated that in practice of the invention, layer 32 should be sufficiently compliant to accommodate the smallest features of the forming surface, but suitably rigid to transmit, without appreciable loss, the electromagnetic force imparted to layer 30. Illustrative, but not limiting, examples of suitable materials for layer 32 are: natural rubbers, fluorocarbon elastomers and suitable polymeric compositions including styrene-butadiene, nitrile, polyurethanes and ethylene-propylene.

Multi-layer driver plate 14 also comprises a third layer 34, sandwiched between first layer 30 and second layer 32 to provide support and overall strength, stiffness and durability to the driver plate. This rigidity-imparting characteristic may be achieved by choice of material, thickness of material or through incorporation of design elements which impart stiffness such as ribs or bosses. Since it is desirable to minimize inertial effects, it will be appreciated that some ingenuity in design and construction may be expended to achieve maximum stiffening effect at minimum mass.

The at least local thickness of the elastomeric second layer 32 should be thicker than the height of the most elevated local feature, for example as depicted at 19 (in FIGS. 1 and 2B), of the forming surface to assure full shape conformance. Although depicted as generally flat in FIG. 2A, the shaping surface 18 may comprise local forming features 19 located or positioned on a generally curved or contoured surface. In this circumstance, the thickness of elastomeric layer 32 should continue to be dictated by the height of local forming feature 19, but the lower surface 33 of support layer 34 should mimic the overall forming surface contour as shown in FIG. 2B.

Thus, in the practice of this invention an SMA workpiece 12 will be positioned on an embossing die 16 with shape-imparting surface 18 comprising shape-imparting features 19 and impacted with the embossing die through the action of a re-usable driver plate as a part of an electromagnetic forming system.

Turning now to the embossing or imprinting die. The imprinting die may be fabricated using a number of approaches. The most direct is to machine and polish, using suitable tools as are well known to those in the art of die-making, a body of suitable material, for example tool steel block(s) directly. This is clearly applicable for features of coarser dimensions but a diamond turning tool, similar to that used to produce diffraction gratings may also be used for fine features if it is desired to fabricate tools exclusively by mechanical means.

For fine featured patterns, many of the lithographic fabrication processes used in semiconductor fabrication may be adapted. For example: expose a negative image of the desired object on a photosensitive polymer or polymer precursor such as a photoresist or photothermoplastic and process the polymer or polymer precursor to create a polymer relief image of the negative form;

a. electroplate nickel on the relief image and, after sufficient build-up is achieved, separate the nickel plating from the polymer relief image to create a positive form of the image;

b. electroplate a thin layer of chromium on the nickel relief image, fill any cavities on the underside of the relief image with a temperature resistant filler with good compressive strength such as a cementitious ceramic compound and mount the composite plated form on a steel backing plate; and c. expose the plated form and backing plate to a carburising atmosphere at elevated temperature for a a time sufficient to substantially transform the chromium to chromium carbide.

This will produce a die with the shock resistance required to sustain the high pressures occurring during impressing and also minimize die wear resulting from the high loads sustained on the sharp features.

Shape memory alloys derive their properties from the fact that they undergo a change in crystal structure without change in composition and that this change in crystal structure may be thermally or mechanically initiated. The transformation is progressive and occurs over a narrow temperature range rather than at a specific temperature. The transformation exhibits some temperature hysteresis in that a transformation from austenite to martensite on cooling and a transformation from martensite to austenite on heating will occur over two distinct temperature ranges. The transformation temperatures are labeled as $M_s$ and $M_f$, corresponding to martensite start and martensite finish (temperature) and $A_s$ and $A_f$ corresponding to austenite start and austenite finish (temperature), where the terms in capitals, austenite and martensite, describe the transformation product. That is, if austenite is cooled, $M_s$ represents the temperature at which it will begin to transform to martensite.

The transformation temperatures represented by these symbols reflect transformations which are temperature-driven and occur under stress-free conditions. These transformations may however be initiated or promoted by the application of stress acting in concert with temperature. Thus there is a temperature, denoted by $M_d$ and higher than $M_s$, which denotes the maximum temperature at which an austenite to martensite transformation may be initiated under the application of a stress.

The first shape memory alloy (SMA) to be extensively studied was a substantially equi-atomic alloy of nickel and titanium, commercially known as nitinol, which continues to be the basis for a series of stoichometric and off-stoichometric nickel titanium SMAs. However, other alloy systems, notably copper-zinc-aluminum-nickel and copper-aluminum-nickel also demonstrate the shape memory effect. Significantly, through control of alloy content and processing, a wide range of transformation temperatures can be achieved ranging from well below room temperature, or about 25° C., to well above the boiling point of water. More specifically $A_s$ temperatures ranging from about −150° C. to about 200° C. have been reported. This diversity of transformation temperatures enables the practice of this invention over a wide temperature range.

It will be appreciated that SMAs may be deformed while in their austenitic or martensitic form and that the state in which they are deformed will lead to different outcomes. If deformed in the austenitic form then deformation proceeds through conventional deformation processes well known to those skilled in the art and results in accumulation of crystal defects, particularly dislocations. If deformed in the martensitic form and the imposed deformation strain is less than the limiting strain, then deformation is accomplished through the recoverable motion of boundaries between different martensite variants and substantially no accumulation of crystal defects occurs. If deformed in the martensitic form to a strain greater than the limiting stain then the strain is partially accommodated by recoverable boundary motion and partly through the generation, movement and accumulation of dislocations. Thus the outcome of any imposed deformation will depend on the phase which is deformed and, if martensite, on whether the strain is greater or less than the (material-dependent) limiting strain.

Figure 3:
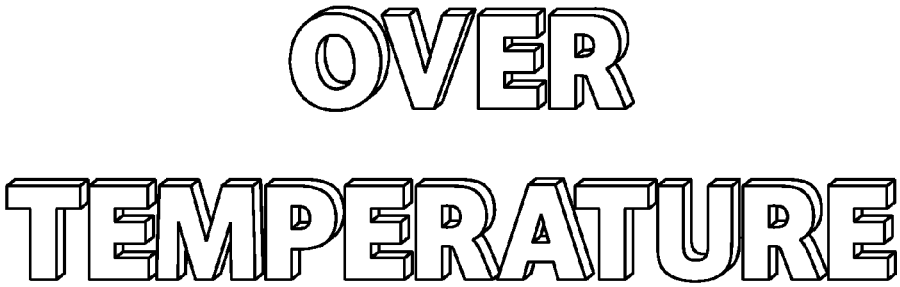
FIG. 3 is a view of an embossment comprising a series of images in the form of an informational message "over temperature" wherein the surface relief of the edges of the letters directly represents the image.
Figure 4:
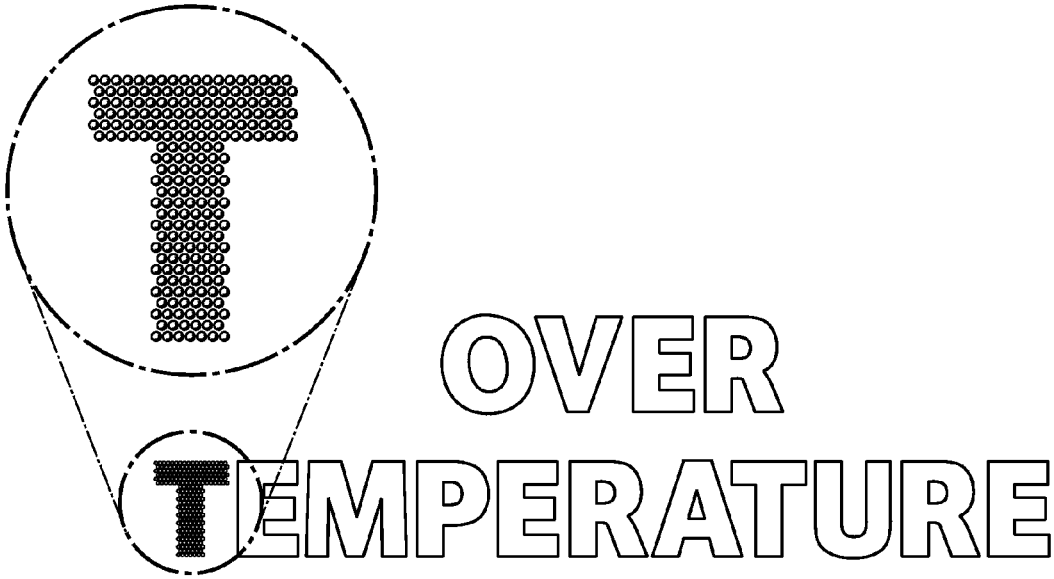
FIG. 4 is a view of a section of an embossment comprising the same informational message, shown in ghost, wherein a fragment of the image is represented by a plurality of small embossed dimple-like features arranged such that the plurality of feature collectively represents the fragmentary image.

In a first embodiment an image is imparted to a substantially flat sheet or foil of SMA in its austenitic form. The image may be embossed with to create features which protrude above the sheet or foil surface, or impressed to create features which extend below the sheet surface. Further the image may be textual, pictorial or a combination of both without restriction. For example, FIGS. 3 and 4 show an example of an embossed message, "Over Temperature", that might be used in packaging of temperature-sensitive products such as medications. In FIG. 3 a single embossment represents an individual feature—a single letter of the message. Each letter may be embossed in the surface of a foil or thin sheet (not indicated) so that the letter is raised above the general surface of the foil. In FIG. 4 the same message "Over Temperature" is shown, but in this example each letter is represented by an assemblage of embossments of regular geometry, here depicted as sections of generally hemi-spherical shapes and again raised above the surface of the foil or thin sheet, so arranged as to collectively represent the feature. It will be understood that the representations depicted in FIGS. 3 and 4 are exemplary only and are not intended to limit the scale, number or geometry of the embossed features.

This embossing process, conducted while the SMA is in its austenite phase and at a temperature greater than $M_d$, will result in the generation and storage of line defects, dislocations, within the austenite grains of the SMA which will impede the SMA's ability to exhibit a one way shape memory effect. However the influence of these dislocations may be eliminated by subjecting the SMA to an annealing heat treatment, for example 30 minutes at 550° C. under protective atmosphere to avoid oxidation.

After annealing, the austenitic SMA will be cooled to a temperature below its $M_f$ to ensure that it is completely martensitic. Once fully martensitic the embossed shape will be impressed by an amount sufficient to render a flat sheet of SMA again. It will remain in this configuration unless the temperature rises above the $A_f$ temperature or, alternatively stated, it transforms completely back to austenite, whereupon the one way memory effect will undo the impression of the embossed shape rendering it visible again and signaling that the $A_f$ temperature had been attained.

In practice, it will be appreciated that the magnitude, though not the sign, of the strains required to form the embossment initially and to impress the embossment subsequently to render a flat sheet must be of substantially equivalent magnitude. Thus the strain introduced by embossing must be less than the limiting strain required for a one-way shape memory effect.

The limiting strain depends somewhat on the choice of SMA alloy, but is generally less than about 8%, and may, for some copper-based alloy systems, be less than 5%. Thus the nature and form of the embossments are chosen to ensure that the strains generated do not exceed the limiting strain. Hence in the example of FIG. 3, the sidewalls 20 of the images may be sloped rather than vertical and the general form of the image modified as necessary to ensure that even local strains do not exceed the limiting strain. Similarly, in the example of FIG. 4, the embossments may not be hemispherical but rather spherical caps formed by only a partial penetration of a larger radius spherical shape to reduce their associated strain.

These considerations are well known to those skilled in the art of embossing. In conventional materials however the allowable deformation or the height of the embossment is set by the requirement not to tear or split the workpiece. In this case the height of the embossed feature may be comparable to the thickness of the workpiece for tools with rounded features but should not exceed about 50% of the workpiece thickness for tools with sharp features. Since the limiting strain for SMA will be appreciably less than the failure strain, the height of even embossments with rounded features should be maintained at about 20% of workpiece thickness or less.

In a second embodiment, a substantially flat sheet or foil of SMA in its austenitic form is impressed with an image or message or a combination of both to create features below the surface of the sheet or foil. Again, this will result in the formation of dislocations whose number or density must be reduced to an acceptable level by annealing the sheet or foil by an annealing treatment to enable a one-way shape memory effect.

After annealing the sheet or foil is cooled below its $M_f$ temperature to produce a fully martensitic microstructure and the region of the initial impression contacted with substantially flat tools to an extent sufficient to render the region substantially featureless. Thus the features created in the austenite phase will not be visible but may, as in the first embodiment, be rendered visible by heating the sheet or foil to a temperature greater than the $A_f$ temperature of the sheet or foil. Again, it will be appreciated that the strains induced should be less than the limiting strain.

In these embodiments, it is intended that embossed features on SMA be created by mechanical means such as through the action of matched die sets or through the action of a punch against a compliant support, while impressed features may be created by the action of a punch against a rigid support. It will be appreciated that the scale or dimensions of embossed features will be limited by the thickness of the embossed sheet in an inverse manner, that is a thicker sheet will result in larger scale features than a thinner sheet. SMAs are available in a variety of forms and specifically, may be sputtered onto a target to produce thin films. Thus embossing of individual thin films separated from their target substrate may overcome some of the concerns around the generation of fine detail but only at the expense of introducing handling issues in the separation and processing of the unsupported thin films.

By contrast, the scale of impressed features is limited only by the scale of the punch which creates them. Thus, with appropriately scaled punches, it is feasible to adjust the scale of the impressed features over a wide range, from macroscopic to microscopic. Of particular note is the possibility of reproducing extremely fine details such as would enable a holographic image when illuminated. This would require features spaced comparably to those in optical diffraction gratings, that is 1-3 micrometers with similar peak to valley dimensions.

In a third embodiment, this invention may also be practiced to generate a reversible fine scale embossment without limitation of the foil or sheet thickness. The process requires: impressing a feature in a sheet or foil of SMA at a temperature below its $M_f$ temperature, that is when it has a fully martensitic structure, in a manner which introduces, at least locally, a strain greater than its limiting strain; mechanically, chemically or mechano-chemically removing the sections of the surface which were not impressed to create a substantially featureless surface; and heating the foil to a temperature above its $A_f$ temperature. This procedure is shown in FIGS. 5A-E which shows the process in sectional view.

Figure 5A:
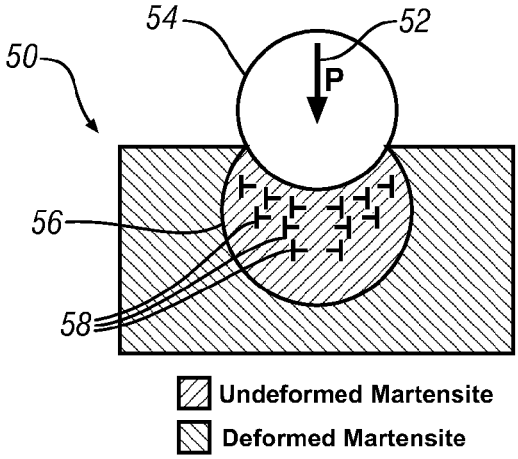
FIGS. 5A-E show a sequence of operations by which an impressed form may be used to create an embossment in a shape memory alloy workpiece which may be rendered either more visible or less visible (FIGS. 5A, B and C) or visible or invisible (FIGS. 5A, D and E) through change of temperature.

In FIG. 5A, a fully-supported SMA foil or sheet which has been cooled below $M_f$ to render it fully martensitic is subjected to penetration by a tool 54 under the urging of a force P directed along the direction of arrow 52. Here tool 54 is depicted with a contact geometry represented, in cross-section, as circular but this illustrative only. The overall tool geometry may generally be a point, a line or a surface without restriction. Upon initial penetration of the SMA by the tool, and until the limiting strain in the SMA is exceeded, the deformation proceeds reversibly and at most only a minimal density or number of dislocations is generated. Upon continued penetration and upon generation of strains greater than the limiting strain a plastically deformed region bounded by 56 incorporating some number or density of dislocations 58 will develop under the tool.

Figure 5B:
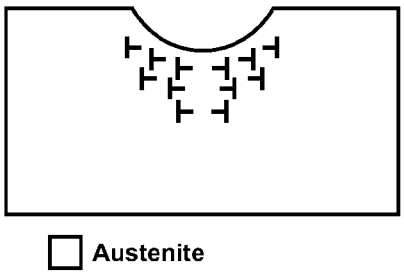
Figure 5D:
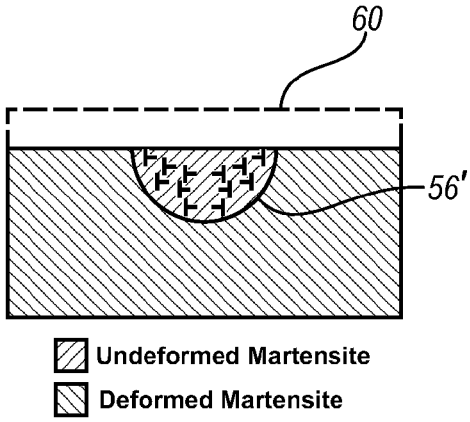
Figure 5C:
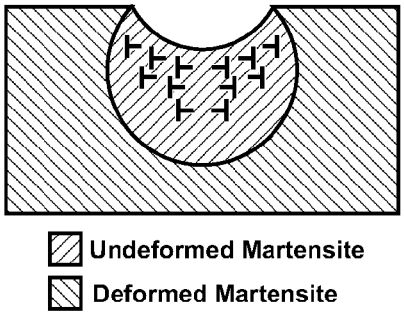

Because the response of the SMA to the impression includes dislocation generation, this approach will enable a two-way shape memory effect. Thus if the temperature of the SMA is raised above its $A_f$ temperature the SMA will adopt a configuration intermediate between its undeformed shape and the impressed shape as illustrated in FIG. 5B. If subsequently again cooled below its $M_f$ temperature the SMA will exhibit an impression of depth approximating the original depth of the impression as shown in FIG. 5C. This thermal cycling may be repeated multiple times with substantially similar results. It may be noted that the dislocations 58 are retained throughout this these thermal excursions.

Figure 5E:
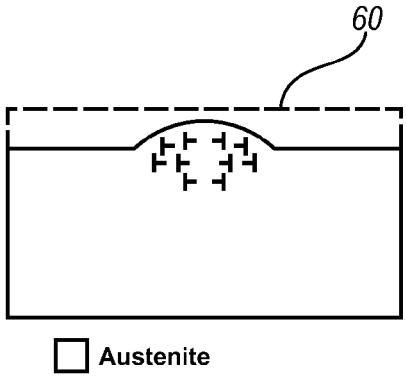

A fourth embodiment of the invention which is a variant of the process described above may be employed to create a reversible embossment. The impressed martensitic surface shown in FIG. 5A is polished, while still martensitic to an extent just sufficient to render it planar, but not to an extent which will eliminate the deformed zone under the impression. The planar configuration resulting is shown in FIG. 5D where the volume of material removed is indicated in dotted outline at 60. Thus the surface geometric features are removed while retaining a substantial fraction of the underlying plastically-deformed zone now indicated in FIG. 5D 56'. If the SMA is now heated above its $A_f$ temperature the occurrence of the shape memory effect will result in an upwelling of material, just as before, but because the surface has been polished flat the upwelling will result in an embossed rather than an impressed feature as shown in FIG. 5E. Again, thermal cycling between the $A_f$ and $M_f$ temperatures will result in substantially reversible appearance and disappearance of the embossed feature.

The planarization of the surface should be conducted with due care to minimize the introduction of global plastic deformation into the surface layers of the SMA. It is preferred that no surface deformation result and thus a preferred approach is to chemically or electrochemically polish the surface. However mechanical polishing may be used provided the scale of the abrasive particles is less than the scale of the features to be removed and only low polishing pressure is applied. Alternatively, mechanical polishing may be performed in conjunction with chemical or electrochemical polishing or chemical or electrochemical etching.

The above process of creating temperature reversible embossments is particularly suitable for the fabrication of fine scale embossments since it desirably enables the use of sputtered thin films fully supported on a substrate. This eliminates the handling issues which would otherwise result from handling of unsupported and therefore fragile thin films if direct embossing were employed.

The use of thin films offers opportunities for achieving progressive shape changes across the entire film surface since the deposition process may be used to controllably modify the film composition. The transformation temperatures of SMAs depend on their composition. Thus any spatial variation in the deposited film composition will enable the transformation to 'switch on' at different temperatures.

Figure 6A:
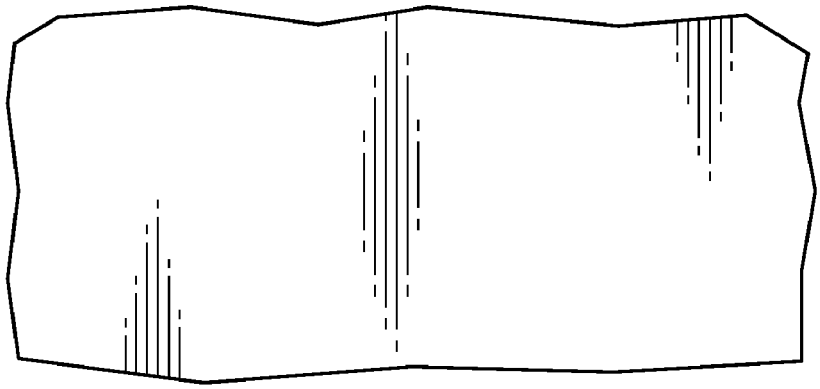
FIGS. 6A-6C illustrate how several images may be constructed by the rendering visible of selective image features—an effect which could be achieved with SMA films of spatially varying composition.
Figure 6B:
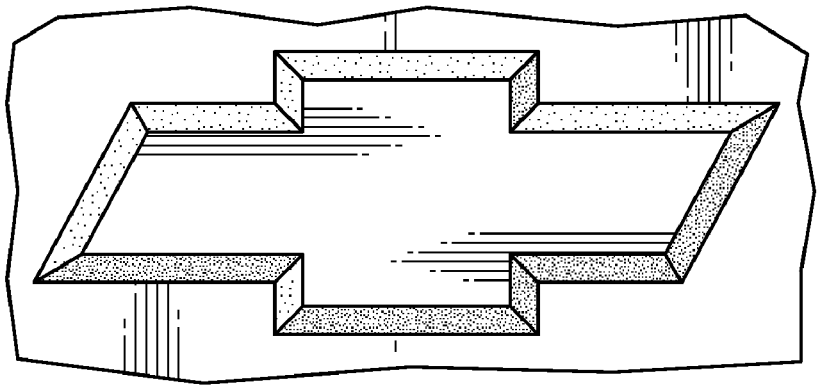
Figure 6C:
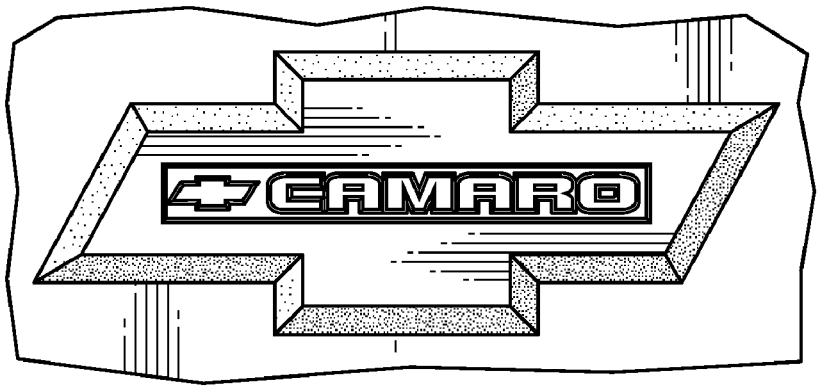

Consider for example a composite SMA foil consisting of two spatially discrete regions, each of which comprises an SMA alloy of specific but unique compositions and each region being characterized by an individual $M_f$ temperature, $M_f'$ and $M_f''$ respectively, where $M_f'$ is a lower temperature than $M_f''$. By cooling the composite foil to a temperature less than $M_f'$, both regions will be fully martensitic. Then by impressing and planarizing as described in embodiment 4 and FIGS. 5A-E, features will be rendered visible above the $A_f$ temperature will be created in each of the regions of the foil. However, because each of the regions has a unique composition it will also have a unique $A_f$ temperature. Thus as the temperature of the SMA foil is increased:

when the SMA foil is at a temperature which is lower than the $A_s$ temperature for both alloy compositions the surface will be planar, and no impressed image will be visible as depicted in FIG. 6A;

when the SMA foil is a temperature above the $A_f$ temperature for one of the regions, say region 1, but below the $A_s$ temperature of the second region, the image impressed in region 1 will become visible as indicated in FIG. 6B;

when the temperature is raised above the $A_f$ temperature for region 2 the image impressed in region 2 will be made visible and this image in combination with the image in region 1 which remains visible, will yield the composite image shown in FIG. 6C.

Variations on this approach may readily be implemented. For example, extensions to more than one spatially varying composition are possible. A similar visual effect may be achieved with a foil of uniform composition if one of the image fragments, for example that shown in FIG. 6B is rendered as permanently visible and the visibility of only the second image fragment depends on the transformation of the SMA.

Significant changes in $M_s$ temperature, on the order 50 kelvins per mol percent of alloy addition, have been recorded in Nickel-Titanium based SMAs with additions of cobalt and chromium. Thus a wide range of characteristics may be imparted to the transforming image with only small changes in chemistry. Spatial selectivity may be achieved by coordinating changes in the deposited composition with masking to restrict deposition to selected areas.

Depending on the state, austenitic or martensitic, of the SMA during forming, one of the processes described in the above embodiments will be followed to create an image whose visibility will depend on the temperature history experienced by the SMA.

It will be appreciated by those skilled in the art that it is possible to combine both impression and embossing by sequential processing for first one process and then other. Thus for example complex image transformations similar to those illustrated in FIGS. 6A-C may be achieved by a combination of the above embodiments.

By way of example:

first follow the process of the third embodiment (that is impress, and polish off the surface relief) to create a featureless surface which on heating will transform to create an embossment; then again impress the surface with a second image which on heating will be substantially transformed back to the flat surface.

On heating the low temperature image created by the impression will disappear on transformation to austenite and the embossed image will appear again offering the opportunity to morph from one image to another on transformation.

The descriptions and embodiments described herein are presented in illustration of the application of the invention and are thus intended to be exemplary and not limiting.

The invention claimed is:

1. A method of making deformed features in a surface of a shape memory alloy workpiece, the deformed features comprising heights, depths, and spacings providing a visible image, the shape memory alloy being of a composition suitable for transforming between a high temperature austenite phase and a low temperature martensite phase over a preselected temperature range; the method comprising:

forming image-forming features in the surface of the shape memory alloy workpiece when the workpiece is in its martensitic phase using electromagnetic fields to urge the shape memory workpiece against a suitable die, the image-forming features being characterized by heights and depths of up to about one millimeter, the image-forming features being modifiable when the workpiece, or an article comprising the workpiece, is heated above the temperature at which the deformed surface transforms to the austenite phase.

2. The method as recited in claim 1 in which the workpiece is in the form of a sheet, a foil, or a thin film, initially substantially flat in both the martensite phase and the austenite phase.

3. The method as recited in claim 1 in which the shape memory alloy comprises nickel and titanium.

4. The method as recited in claim 1 in which the features are imparted by electromagnetically accelerating a striker to apply pressure against the shape memory alloy workpiece sufficient to deform the workpiece against a die.

5. The method as recited in claim 4 in which the die is formed by mechanical shaping or by lithographic processing.

6. The method as recited in claim 5 in which the die is formed by the steps of:

exposing a negative image of the desired object on a photosensitive polymer or polymer precursor such as a photoresist or photothermoplastic;

processing the polymer or polymer precursor to create a polymer relief image of the negative form;

electroplating nickel on the relief image and, after sufficient build-up is achieved, separating the nickel plating from the polymer relief image to create a positive form of the image;

electroplating a thin layer of chromium on the nickel relief image;

filling any cavities on the underside of the relief image with a temperature resistant filler with good compressive strength such as a cementitious ceramic compound; and mount the composite plated form on a steel backing plate; and exposing the plated form and backing plate to a carburizing atmosphere at elevated temperature for a time sufficient to substantially transform the chromium to chromium carbide.

7. The method as recited in claim 1 in which the workpiece is an initially contoured sheet, foil, or thin film, in both the martensite phase and in the austenite phase.

8. A method of making deformed features in a surface of a shape memory alloy workpiece, the deformed features comprising heights, depths, and spacings providing a visible image, the shape memory alloy being of a composition suitable for transforming between a high temperature austenite phase and a low temperature martensite phase over a preselected temperature range; the method comprising:

forming image-providing features in the surface of the shape memory alloy workpiece when the workpiece is in its martensitic phase using electromagnetic fields to urge the shape memory workpiece against a suitable die to simultaneously introduce strain in the surface of the workpiece, the image forming features being characterized by heights and depths of up to about one millimeter, the image forming features being modifiable when the workpiece, or an article containing the workpiece, is heated above the temperature at which the deformed surface transforms to the austenite phase; and removing material of the image forming features from the surface of the workpiece in an amount to just smoothen the surface; the effect of the forming of the image forming features and simultaneous strain and the removal of their material being such that image forming features re-appear when the workpiece is subsequently heated and transformed into its austenite phase.

9. The method as recited in claim 8 in which the shape memory alloy comprises nickel and titanium.

10. The method as recited in claim 8 in which the smooth surface is rendered by mechanical polishing, chemical polishing, electrochemical polishing or a combination of these methods.

11. The method as recited in claim 8 in which the workpiece surface is initially contoured in the martensite phase and in the austenite phase.

12. The method as recited in claim 8 in which the workpiece is in the form of a substantially flat sheet, a foil, or a thin film.

13. A method of making deformed features in a surface of a shape memory alloy workpiece, the deformed features comprising heights, depths, and spacings providing a visible image, the shape memory alloy being of a composition suitable for transforming between a high temperature austenite phase and a low temperature martensite phase over a preselected temperature range; the method comprising:

preparing the workpiece by forming image-providing features in the surface of the shape memory alloy workpiece when the workpiece is in its austenite phase using electromagnetic fields to urge the shape memory workpiece against a suitable die to simultaneously introduce strain of less than the limiting strain in the surface of the workpiece, the image forming features being characterized by heights and depths of up to about one millimeter;

further preparing the workpiece by annealing workpiece at a temperature and for a duration suitable for substantially reducing any crystal defects arising from the deformation; then cooling the shape memory alloy workpiece and transforming the shape memory alloy workpiece completely to its low temperature martensite phase; and deforming the shape memory alloy workpiece while it is maintained in its martensite phase, the shape memory alloy workpiece being deformed to eliminate the surface features on the shape memory alloy workpiece by application of strains substantially equal in magnitude but opposite in sign to the strains applied to create the features.

14. The method as recited in claim 12 in which the shape memory alloy comprises nickel and titanium.

15. The method as recited in claim 12 in which the workpiece is in the form of a substantially flat sheet, a foil, or a thin film.

16. The method as recited in claim 12 in which the workpiece surface initially contoured in both the martensite phase and in the austenite phase.

17. A method of making deformed features in a surface of a shape memory alloy workpiece, the deformed features comprising heights, depths, and spacings providing a visible image, the shape memory alloy workpiece comprising surface regions, the regions being of a plurality of compositions, each suitable for transforming between a high temperature austenite phase and a low temperature martensite phase over a pre-selected temperature range; the method comprising:

forming image-forming features in the surface regions of the shape memory alloy workpiece when all regions of the workpiece are in their martensite using electromagnetic fields to urge the shape memory workpiece against a suitable die, the image-forming features being characterized by heights and depths of up to about one millimeter, the image-forming features being selectively modifiable when at least one the workpiece surface regions, or an article comprising the at least one of the workpiece surface regions, is heated above the temperature at which the deformed surface region transforms to the austenite phase.

18. The method of claim 17 wherein the shape memory alloy workpiece comprises nickel and titanium.

19. The method of claim 17 wherein the workpiece surface is initially contoured in both the martensite phase and in the austenite phase.

20. The method as recited in claim 17 in which the workpiece is in the form of a substantially flat sheet, a foil, or a thin film.

* * * * *